US010584542B2

(12) United States Patent
Hoyvik

(10) Patent No.: US 10,584,542 B2
(45) Date of Patent: Mar. 10, 2020

(54) ANCHORING SUBSEA FLEXIBLE RISERS

(71) Applicant: Subsea 7 Norway AS, Stavanger (NO)

(72) Inventor: Eskil Hoyvik, Stavanger (NO)

(73) Assignee: Subsea 7 Norway AS, Stavanger (NO)

( * ) Notice: Subject to any disclaimer, the term of this patent is extended or adjusted under 35 U.S.C. 154(b) by 107 days.

(21) Appl. No.: 15/323,030

(22) PCT Filed: Jul. 2, 2015

(86) PCT No.: PCT/EP2015/065158
§ 371 (c)(1),
(2) Date: Dec. 29, 2016

(87) PCT Pub. No.: WO2016/001386
PCT Pub. Date: Jan. 7, 2016

(65) Prior Publication Data

US 2017/0350196 A1 Dec. 7, 2017

(30) Foreign Application Priority Data

Jul. 4, 2014 (GB) ..... 1411988.7

(51) Int. Cl.
*E21B 17/01* (2006.01)
*E21B 17/08* (2006.01)
*E21B 43/01* (2006.01)

(52) U.S. Cl.
CPC ..... *E21B 17/015* (2013.01); *E21B 17/017* (2013.01); *E21B 17/085* (2013.01); *E21B 43/0107* (2013.01)

(58) Field of Classification Search
CPC .... E21B 17/015; E21B 17/017; E21B 17/085; E21B 43/0107
USPC ..... 405/224, 224.2–224.4
See application file for complete search history.

(56) References Cited

U.S. PATENT DOCUMENTS 4,615,646 A * 10/1986 Langner ..... E21B 43/0107 405/169
2003/0086763 A1 5/2003 Hooper et al.
2004/0156684 A1 8/2004 Pionetti
2007/0081862 A1 4/2007 Wolbers et al.

FOREIGN PATENT DOCUMENTS

| | | |
|---|---|---|
| EP | 0 894 938 | 2/1999 |
| GB | 2 306 608 | 5/1997 |
| GB | 2 410 756 | 8/2005 |
| GB | 2468918 | 9/2010 |
| WO | WO 03/012327 | 2/2003 |

* cited by examiner

*Primary Examiner* — Tara Mayo-Pinnock
(74) *Attorney, Agent, or Firm* — Levy & Grandinetti

(57) ABSTRACT

A subsea flexible riser installation has a seabed foundation and a steep-configuration flexible riser anchored to the seabed by the foundation. An attachment formation is fixed relative to the riser and a locating formation is fixed relative to the foundation, both at positions elevated above the seabed. The locating formation is engaged with the attachment formation on the riser. This holds the attachment formation and the riser against movement when engaged, protecting the base of the riser from over-bending and fatigue.

13 Claims, 1 Drawing Sheet

ANCHORING SUBSEA FLEXIBLE RISERS

Figure 1:
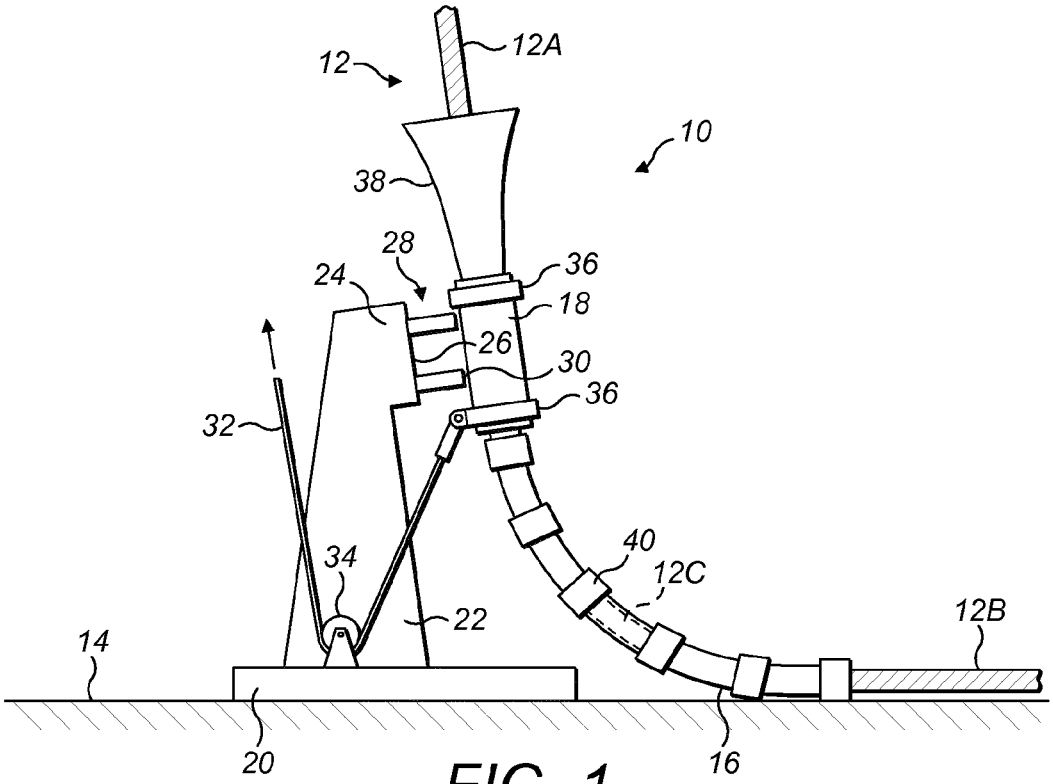

This invention relates to systems and methods for anchoring dynamic flexible risers as used in the subsea oil and gas industry.

In offshore oil and gas production, production fluid comprising crude oil and/or natural gas must be transported from a subsea wellhead to the surface. For this purpose, production fluid flows along subsea pipelines comprising flowlines on the seabed and riser pipes extending upwardly from the seabed. At the surface, the production fluid typically undergoes treatment and temporary storage at a surface installation such as a platform or a floating production, storage and offloading vessel (FPSO).

In this specification, references to risers are not confined to pipes that carry production fluid. Risers may also include dynamic umbilicals or cables such as copper or fibre-optic cables for conveying fluids, power and/or data between the surface and the seabed in support of subsea production operations.

Risers typically comprise a bottom section running generally horizontally in parallel to the seabed and an upright ascending section extending from the bottom section toward the surface. The ascending section is steeply inclined or substantially vertical, and may be substantially straight or curved along its length.

A sharply-curved bottom bend or sag bend section redirects the riser between the horizontal bottom section and the upright ascending section. The sag bend section extends upwardly along the riser from a touchdown point, at which the riser starts to bend away from contact with the seabed. It is in the sag bend section that the riser is most vulnerable to damage due to over-bending and fatigue as the riser flexes during installation and in use.

In a free-hanging configuration, a riser may be suspended as a catenary that is redirected with relatively sharp curvature in the sag bend section to run along the seabed. Various other configurations are known in which a riser is given intermediate support by buoyancy or other means at one or more locations in mid-water between the surface and the seabed. Such intermediate support imparts an undulating shape to the ascending section of the riser, which helps to isolate the sag bend section from dynamic movement of the upper end of the riser as may be driven by wave or tide action. Examples are 'lazy-S', 'steep-S', 'lazy-wave', 'steep-wave' and 'pliant-wave' configurations. Some such configurations are disclosed in the American Petroleum Institute's Recommended Practice for Flexible Pipe, publication 17B (API RP17B).

The invention is concerned with flexible risers, or at least with risers that are flexible in and around the sag bend section. Those skilled in the art clearly understand the meaning of 'flexible' in the context of fluid-carrying conduits such as risers; they also understand the distinction between flexible and rigid conduits.

Specifically, the terms 'flexible' and 'rigid' have clear meanings in the subsea oil and gas industry that differ in important respects from general language and indeed from the strictest meaning of those terms. In particular, despite their names, flexible pipes are not fully flexible beyond the limit of bending strain; nor are rigid pipes devoid of flexibility.

Flexible pipes used in the subsea oil and gas industry are specified in API (American Petroleum Institute) Specification 17J and API Recommended Practice 17B. The pipe body is composed of a composite structure of layered materials, in which each layer has its own function. Typically, polymer tubes and wraps ensure fluid-tightness and thermal insulation. Conversely, steel layers or elements provide mechanical strength; for example, interlocked steel tapes form a carcass or pressure vault and a tensile armour is formed of helically-wound wire. Flexible pipes are terminated and assembled by end fittings.

The structure of a flexible pipe allows a large bending deflection without a significant increase in bending stresses. The bending limit of the composite structure is determined by the elastic limit of the outermost plastics layer of the structure, typically the outer sheath, which limit is typically 6% to 7% bending strain. Exceeding that limit causes irreversible damage to the structure. Consequently, the minimum bending radius or MBR of flexible pipe used in the subsea oil and gas industry is typically between 3 and 6 metres.

Rigid pipes used in the subsea oil and gas industry are specified in API Specification 5L and Recommended Practice 1111. In contrast to flexible pipes, a rigid pipe usually consists of or comprises at least one pipe of solid steel or steel alloy. However, additional layers of materials can be added, such as an internal liner layer or an outer coating layer. Such additional layers can comprise polymer, metal or composite material. Rigid pipes are terminated by a bevel or a thread, and are assembled end-to-end by welding or screwing them together.

The allowable in-service deflection of rigid pipe is determined by the elastic limit of steel, which is around 1% bending strain. Exceeding this limit caused plastic deformation of the steel. It follows that the MBR of rigid pipe used in the subsea oil and gas industry is typically around 100 to 300 metres. However, slight plastic deformation can be recovered or rectified by mechanical means, such as straightening. Thus, during reel-lay installation of a rigid pipeline made up of welded rigid pipes, the rigid pipeline can be spooled on a reel with a typical radius of between 8 and 10 metres. This implies a bending strain above 2% for conventional diameters of rigid pipes, requiring the pipe to be straightened mechanically during unreeling.

Polymer composite pipes are also known but are not yet specified in standards tailored to the subsea oil and gas industry. Such pipes are based on a pipe made of polymer resin reinforced by fibre material, such as glass fibres or carbon fibres. Additional layers such as coatings can be added. Like flexible pipes, polymer composite pipes are terminated and assembled by end fittings. Polymer composite pipes are substantially rigid and stiff but can withstand more bending strain than rigid steel pipes; however, they cannot flex like flexible pipes.

Length-for-length, flexible risers are more expensive than rigid risers but they have various advantages in relation to rigid risers. For example, a flexible riser can follow a tighter bend radius in the sag bend section without risking damage. This allows a more compact riser arrangement. Additionally, a flexible riser has better fatigue performance, is less sensitive to vortex-induced vibrations and can accommodate a greater range of relative movement between its upper end and the touchdown point. However, controlling the bending radius of flexible pipe is critical for reliability.

The invention is particularly concerned with flexible riser arrangements in which a seabed anchor or foundation acting on the riser controls the touchdown point, such that tension in the riser is transmitted to the anchor and not to the seabed at the touchdown point. Such anchors characterise the steep-S and steep-wave configurations.

In conjunction with an anchor, a guide arrangement is required to keep a flexible riser at the desired touchdown point while protecting the riser from excessive bending or fatigue in the sag bend section.

For example, EP 0894938 discloses a flexible riser whose ascending section is supported in a steep-S configuration. The sag bend section of the riser is fitted with a bend limiter, also known as a bend restrictor. The bend limiter comprises a series of articulated interlocking elements like vertebrae around the riser that interact with each other as the riser bends. On reaching a bend limit, the elements lock together to enforce a minimum bend radius on the riser they surround. A yoke is clamped around the sag bend section of the riser, either directly or via the bend limiter. The yoke is tethered by a wire link to a fixed tethering point on a deadweight foundation.

The wire link of EP 0894938 allows the yoke and hence the sag bend section of the riser to move relative to the foundation. Thus, whilst the bend limiter limits the amplitude of dynamic bending, the sag bend section will still experience repeated bending cycles and hence fatigue. In essence, the bend limiter resists static loads of over-bending during installation and retrieval of the riser but it cannot effectively resist dynamic loads caused by movement of the riser during operation.

GB 2410756 discloses one of the Applicant's earlier solutions to anchor the sag bend section of a flexible riser. That solution comprises a subsea foundation fitted with a sheave to pull the sag bend section into position atop the foundation, to which the sag bend section is then connected by shackles.

In GB 2410756, the sag bend section is sleeved by a rigid curved conduit that has to be fitted to the flexible riser before laying. The angle between the horizontal bottom section and the upright ascending section of the riser is predetermined by the curvature of the conduit and so is fixed before laying. Consequently, the arc described by the sag bend section cannot be modified during or after laying to accommodate tolerances in the position of the foundation and the length of the pipeline sections.

US 2007/0081862 describes an alternative riser anchoring system for deep-water applications. In that example, the riser is a hybrid riser held upright and in tension by a subsea buoyancy module positioned at a depth below the influence of wave action.

Consequently, the riser anchoring system restricts upward movement of the riser rather than bending caused by lateral motion of the riser.

Various embodiments of US 2007/0081862 use a wire, a chain or a rod as a link between a foundation and the riser. When under steady upward tension as applied by a hybrid riser in deep water, a wire, chain or rod can restrain upward movement of the riser and thereby effectively maintain a desired curvature in the sag bend section. However, such links cannot resist compressive or bending forces, as would be applied to a link between a riser and a foundation in shallower water. In that case, like EP 0894938 above, the sag bend section would experience repeated bending cycles and hence fatigue.

Additionally, a rod link as proposed by US 2007/0081862 is not practical to install in shallow water: aligning and fitting such a rod into a receptacle is not feasible as the riser will move during installation due to sea dynamics and heave of the installation vessel. To make a rod link work, the rod would have to be pre-installed on the foundation, a connection system would have to be moved from the foundation to the free end of the rod, and an alignment and attachment system would have to be added to couple the rod and the riser. US 2007/0081862 suggests no such measures. Also, some embodiments of US 2007/0081862 comprise a fixed guide through which a riser pipe can slide. Such an arrangement is not suitable for a flexible riser, as friction would wear away the outer sheath of such a riser.

A different type of approach is shown in US 2004/156684 which describes a discontinuous riser connection comprising three distinct sections: a rigid vertical riser, a rigid horizontal pipeline that rests on the seabed, and a flexible element providing communication between the rigid sections and accommodating the change in angle from horizontal to vertical. The vertical riser is supported by a bracket upstanding from a seabed anchor. US 2004/156684 therefore relates to an alternative to a steep configuration riser in which a sag portion of a continuous length of flexible pipe accommodates a right angle. A drawback in the approach taken in US 2004/156684 is that the pipeline must be assembled on land together with the seabed anchor prior to laying.

It is against this background that the present invention has been devised.

In one sense, the invention resides in a subsea flexible riser installation, comprising: a seabed foundation; a steep-configuration flexible riser anchored to the seabed by the foundation; an attachment formation fixed relative to the riser at a position elevated above the seabed; and a locating formation fixed relative to the foundation at a position elevated above the seabed, the locating formation being engageable with the attachment formation on the riser to hold the attachment formation and the riser against movement when so engaged.

The attachment formation is conveniently fixed directly to the riser but could be movable along and lockable relative to the riser.

Preferably, the installation comprises an upright rigid locating structure that is attached rigidly to or integral with the foundation and that supports the locating formation rigidly. The locating formation is suitably oriented to engage an outer surface of the attachment formation that is within 15° of vertical, generally parallel to a similarly-oriented underlying part of the riser.

Advantageously, a pulling system acts directly or indirectly between the riser and the foundation to pull the attachment formation toward the locating formation.

A locking mechanism may be provided for locking the attachment formation to the locating formation. Such a mechanism suitably holds a convex surface of the attachment formation in engagement with a complementary concave locating surface of the locating formation.

The riser typically extends from a generally horizontal bottom section to a generally upright ascending section via a curved sag bend section extending upwardly from the seabed. In that case, the attachment formation is preferably positioned above the sag bend section. For example, the attachment formation may be positioned level with an ascending section of the riser adjacent to the sag bend section.

A lower bend controller is preferably positioned between the attachment formation and the seabed to act on the sag bend section of the riser. Similarly, an upper bend controller is preferably positioned between the attachment formation and an upper end of the riser to act on the ascending section of the riser. In either case, the upper and/or lower bend controller is conveniently supported by the attachment formation.

The inventive concept also embraces a method of anchoring a steep-configuration flexible subsea riser to the seabed, the method comprising engaging an attachment formation with a locating formation, wherein the attachment formation is fixed relative to the riser and the locating formation is fixed relative to a seabed foundation, both at positions elevated above the seabed.

The method preferably comprises pulling the attachment formation into engagement with the locating formation and then locking the engaged attachment formation to the locating formation.

Advantageously, bends in an ascending section and/or a sag bend section of the riser may be restricted or stiffened while corresponding reaction loads are fed to the foundation via the attachment formation.

The attachment formation may be positioned above the seabed by moving the attachment formation along the riser before locking the attachment formation relative to the riser.

In summary, the invention provides a system and a method to install, anchor and attach the lower bend of a flexible riser in a steep configuration (in particular, steep-wave or steep-S) in shallow water. A base structure comprises a foundation in the seabed and an upright structure with a receptacle to couple the flexible riser to the upright structure. A pulling system such as a return sheave or winch pulls the flexible riser toward the receptacle.

The invention allows a bend in a flexible pipe to follow a pre-determined path and to be held against forces that would otherwise cause fatigue-promoting movement.

Accessories mounted on the flexible riser may comprise: a bend-restricting device to limit curvature in the bend region of the flexible riser; and a clamp to couple a lower point of a near-vertical ascending section of the riser to the receptacle. Accessories mounted on the flexible riser may also comprise a flare or a bend stiffener above the clamp to deal with the bending moment between the fixed clamp position and the ascending section of the riser, whose angle to the vertical may be up to 15°. The accessories may be able to slide and to be locked on the flexible riser for precise positioning.

Figure 2:
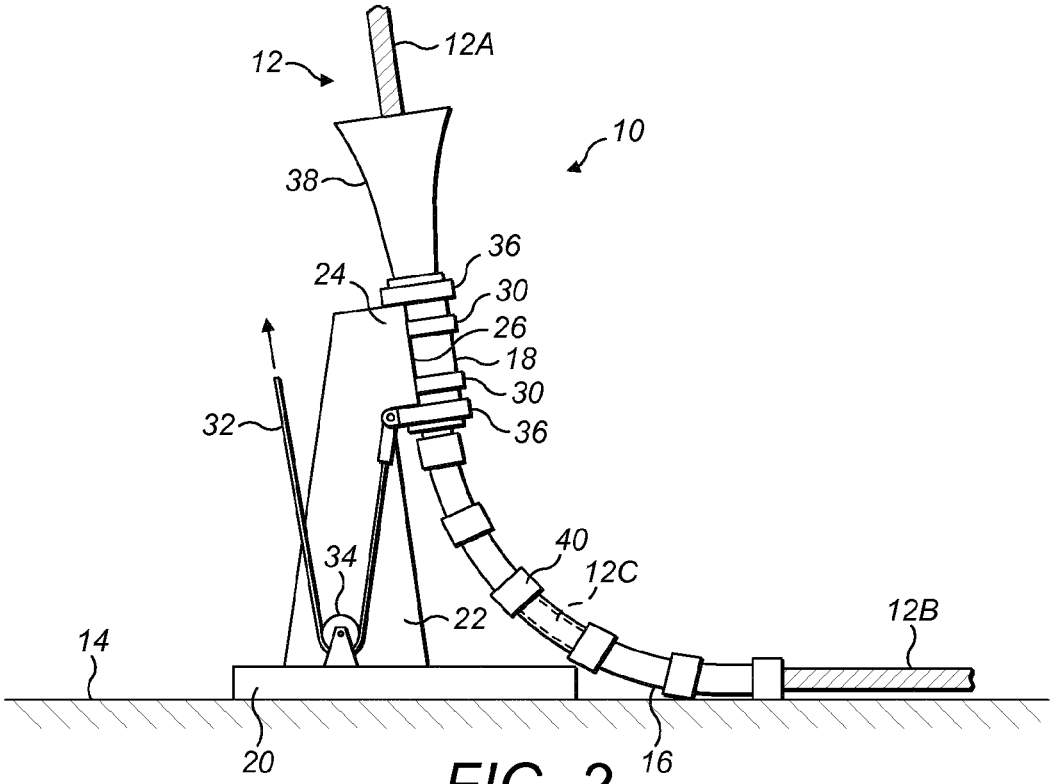

In order that the invention may be more readily understood, reference will now be made, by way of example, to the accompanying drawings in which:

FIG. 1 is a side view of an anchor arrangement for a flexible riser in accordance with the invention, with the riser being pulled toward an upstanding rigid locating structure atop a subsea anchor; and FIG. 2 corresponds to FIG. 1 but shows the riser engaged with a locating formation of the locating structure.

FIGS. 1 and 2 show an anchor arrangement 10 in accordance with the invention for anchoring a flexible riser 12 in a steep-wave or steep-S configuration in shallow water. 'Shallow' means that the water is shallow enough for wave or tide action typical of that location to impart movement along the length of the riser 12 during operation. Such a depth may, for example, be 100 m to 500 m, with about 150 m being typical.

The riser 12 extends in a continuous length through the anchor arrangement 10, hence obviating a subsea connection such as a flange connection that is commonly used at the base of a riser in steep-wave configurations. The riser 12 comprises an upright ascending section 12A extending toward the surface (not shown) and a bottom section 12B extending from the ascending section 12A generally horizontally in parallel to the seabed 14. A sharply-curved sag bend section 12C is disposed between the ascending section 12A and the bottom section 12B. The sag bend section 12C extends upwardly along the riser 12 from a touchdown point 16, at which the riser 12 starts to bend away from contact with the seabed 14.

In this example, the ascending section 12A is steeply inclined at an angle of up to 15° to the vertical adjacent to the anchor arrangement 10, although this inclination will vary in accordance with any curvature of the ascending section 12A along its length.

The anchor arrangement 10 comprises a tubular sleeve or clamp 18 that encircles the riser 12 and is fixed to the riser 12 at a position elevated above the seabed 14. In this example, the clamp 18 is positioned around the bottom of the ascending section 12A, just above the sag bend section 12C. Here, the riser 12 and hence the clamp 18 experiences zero bending moment in a nominal configuration.

The clamp 18 may be attached to the riser 12 by friction or by welding; the attachment method will depend upon the material from which the riser 12 is made. The clamp 18 may be attached to the riser 12 at an onshore fabrication site or offshore on board an installation vessel.

A subsea anchor 20 or foundation such as a pile or a deadweight block is embedded in the seabed 14. The anchor 20 is surmounted by an upstanding rigid locating structure 22, whose lower end is fixed to the anchor 20. An upper end of the locating structure 22 comprises a locating formation 24 that is shaped as a receptacle to interface with and to hold the clamp 18 that encircles the riser 12. Specifically, in this example, the locating formation 24 presents a complementary concave part-cylindrical seating surface 26 to the clamp 18 at the same elevation as that of the clamp 18 above the seabed 14. The seating surface 26 is oriented to match the inclination of the riser 12 and hence of the clamp 18 at that elevation.

The locating structure 22 supports a locking mechanism 28 acting in opposition to the seating surface 26 of the locating formation 24. In this example, the locking mechanism 28 comprises restraining bands 30 although other locking arrangements are possible.

A wire 32 is attached to the clamp 18 to pull the clamp 18 into engagement with the seating surface 26 of the locating formation 24 during installation of the riser 12, as shown in FIG. 1. The anchor 20 supports a return sheave 34 around which the wire 28 passes so that upward tension on the wire 32 pulls the clamp 18 and the riser 12 downwardly. The clamp 18 terminates in flanges 36 that engage with the locating formation 24 above and below the seating surface 26 to ensure axial location of the riser 12.

Once the wire 32 and the sheave 34 have been used to pull the clamp 16 into engagement with the seating surface 26 of the locating formation 24 as shown in FIG. 2, the locking mechanism 28 is operable by a diver or ROV to embrace the clamp 18 on the riser 12. The locking mechanism 28 pulls the clamp 18 into closer engagement with the locating formation 24 or at least prevents the clamp 18 being pulled away from and hence disengaging from the locating formation 24.

When the clamp 18 is engaged rigidly with the locating formation 24 of the locating structure 22, the clamp 18 and the riser 12 are restrained against axial and lateral movement and also against rotation. Thus, when so engaged, the clamp 18 serves as an attachment formation for holding the base of the riser 12 in a fixed position relative to the seabed 14.

The anchor arrangement 10 further comprises upper and lower bend controllers positioned around the riser 12 respectively above and below the clamp 18. In this example, an upper bend controller comprises a bellmouth 38, flare or 'tulip' that mitigates overbending and fatigue of the riser 12 by managing the bending moment between the fixed clamp 18 and the ascending section 12A of the riser 12.

The bellmouth 38 is an upwardly-flared generally conical bend restrictor that is supported by the clamp 18, for example by being fixed to an upper end of the clamp 18 by bolts. The bellmouth 38 has a horn- or trumpet-like shape that is rotationally symmetrical about a central longitudinal axis, which axis is aligned with the central longitudinal axis of the clamp 18. The bellmouth 38 may be in two parts to enable it to be assembled around the riser 12 offshore.

It will be apparent that the rigid engagement of the clamp 18 to the locating formation 24 of the locating structure 22 holds the bellmouth 38 rigidly relative to the anchor 20, hence increasing the effectiveness of the bellmouth 38 to protect the riser 12.

In this example, the lower bend controller is a vertebrae bend restrictor 40 comprising interacting elements of steel or polymer. An upper end of the bend restrictor 40 is attached to the clamp 18 such that the bend restrictor 40 hangs from the clamp 18 around the riser 18. The bend restrictor 40 extends from the clamp 18 along the sag bend section 12C and past the touchdown point 16 to the bottom section 12B of the riser 12. The bend restrictor 40 particularly protects the sag bend section 12C of the riser 12 from overbending during installation as shown in FIG. 1, but may also provide protection to the riser 12 during operation.

In a possible variant of the invention, the clamp need not be installed at an angle that gives zero bending moment at a nominal configuration. Instead, for example, the clamp could be held generally horizontal to create an overbend section of the riser between the sag bend section and the ascending section of the riser within the clamp. In that case, the bellmouth of FIGS. 1 and 2 could be replaced with an underbender guide serving as an upper bend controller.

In other variants of the invention, the upper bend controller need not be a bellmouth or an underbender guide but could instead be a bend stiffener, which again is suitably fixed to the clamp. A bend stiffener is distinguished from a bend restrictor in that it resists bending with progressively increasing resistance, particularly adjacent to the interface between the flexible riser and the fixed clamp. Similarly, the lower bend controller need not be a bend restrictor but could instead be a bend stiffener or a downwardly-flared bellmouth, either of which is also suitably fixed to the clamp.

Again, where a fixed clamp supports the upper and/or lower bend controllers, this increases their effectiveness to protect the riser. Also, reaction loads arising from controlling bends in the riser may conveniently be fed to the anchor and the seabed via the clamp and the locating structure.

Many other variations are possible within the inventive concept. For example, the sheave may be a snatch block whose side plate can be opened to insert the wire without having to thread the wire through the block. Alternatively, a winch may replace the sheave. To overcome high alignment loads during the final part of pull-in, a hydraulic pulling system could be used in addition to a wire, sheave or winch, thus potentially reducing the size or weight of the anchor.

The clamp and/or the upper and/or lower bend controllers may be arranged to slide along and then lock to the riser for precise positioning relative to the sag bend section. Such operations may be performed above or preferably below the water surface.

The invention claimed is:

1. A subsea flexible riser installation, comprising:

a seabed foundation;

a steep-configuration flexible riser anchored to the seabed by the foundation, the riser extending in a continuous length from a bottom section through a sag bend to an ascending section;

an attachment formation fixed relative to the riser at a position elevated above the seabed, the attachment formation being movable along and lockable relative to the riser;

a locating formation fixed relative to the foundation at a position elevated above the seabed, the locating formation being engageable with the attachment formation on the riser to hold the attachment formation against axial, lateral and rotational movement when so engaged; and a pulling system acting directly or indirectly between the riser and the foundation for pulling the attachment formation toward the locating formation.

2. The installation of claim 1 further comprising an upright rigid locating structure that is attached rigidly to or integral with the foundation and that supports the locating formation rigidly.

3. The installation of claim 1, wherein the attachment formation is fixed directly to the riser.

4. The installation of claim 1 further comprising a locking mechanism for locking the attachment formation to the locating formation.

5. The installation of claim 4, wherein the locking mechanism holds a convex surface of the attachment formation in engagement with a complementary concave locating surface of the locating formation.

6. The installation of claim 1, wherein the bottom section is generally horizontal, the ascending section is generally upright, and the sag bend section is curved and extends upwardly from the seabed, and the attachment formation is positioned above the sag bend section.

7. The installation of claim 6, wherein the attachment formation is positioned level with an ascending section of the riser adjacent to the sag bend section.

8. The installation of claim 6 further comprising a lower bend controller positioned between the attachment formation and the seabed to act on the sag bend section of the riser.

9. The installation of claim 8, wherein said bend controller is supported by the attachment formation.

10. The installation of claim 6 further comprising an upper bend controller positioned between the attachment formation and an upper end of the riser to act on the ascending section of the riser.

11. The installation of claim 1, wherein the locating formation is oriented to engage an attachment formation that is within 15° of vertical.

12. A method of anchoring a steep-configuration flexible subsea riser to the seabed, the riser extending in a continuous length from a bottom section through a sag bend to an ascending section, the method comprising: positioning an attachment formation at a position elevated above the seabed by moving the attachment formation along the riser before locking the attachment formation relative to the riser; and pulling the attachment formation into engagement with a locating formation and then locking the engaged attachment formation to the locating formation, wherein the locating formation is fixed relative to a seabed foundation located at the seabed a position elevated above the seabed.

13. The method of claim 12 further comprising restricting or stiffening bends in an ascending section and/or a sag bend section of the riser while feeding corresponding reaction loads to the foundation via the attachment formation.

* * * * *